US006758170B1

(12) United States Patent
Walden

(10) Patent No.: US 6,758,170 B1
(45) Date of Patent: Jul. 6, 2004

(54) MULTI-CYCLE TRAINABLE PISTON ENGINE

(76) Inventor: Sean Walden, 6696 B 107th St., Ewa Beach, HI (US) 96706

( * ) Notice: Subject to any disclaimer, the term of this patent is extended or adjusted under 35 U.S.C. 154(b) by 4 days.

(21) Appl. No.: 10/323,266

(22) Filed: Dec. 18, 2002

(51) Int. Cl.[7] ..... F02M 25/06
(52) U.S. Cl. ..... 123/21; 123/45 R
(58) Field of Search ..... 123/21, 45 R

(56) References Cited

U.S. PATENT DOCUMENTS 5,007,382 A 4/1991 Kawamura
5,193,492 A 3/1993 Kawamura
5,517,951 A 5/1996 Paul et al.
5,699,758 A 12/1997 Clarke

*Primary Examiner*—Noah P. Kamen
(74) *Attorney, Agent, or Firm*—Michael I. Kroll

(57) ABSTRACT

A multiple-cycle engine is provided that alternates between two-cycle and four-cycle operation in response to measured engine conditions. Each piston is ball and socket mounted to allow the piston to be trained to five positions by a training block within the cylinder wall. Intake and scavenging port runners and a piston port align to place a fuel charge in the combustion chamber in the first position, while the second position seals it for compression and ignition. A piston exhaust vent aligns with an exhaust port in the third position to discharge the exhaust for completion of four-cycle operation. In a fourth position, the intake port and a second scavage port runner align to fuel the combustion chamber, while exhaust leaves through a second piston exhaust vent in alignment with the exhaust port incoming charge is scavenged by the suction of a megaphone type exhaust pipe. In a fifth position, the chamber is sealed for compression and ignition for completion of two-cycle operation.

16 Claims, 10 Drawing Sheets

Four Cycle Mode

Position I
INTAKE

Four Cycle Mode

Position 2

COMPRESSION/FIRE

Four Cycle Mode
Position 3
EXHAUST

Two Cycle Mode
Position 4
INTAKE/EXHAUST

Two Cycle Mode

Position 5

COMPRESSION/POWER

MULTI-CYCLE TRAINABLE PISTON ENGINE

BACKGROUND OF THE INVENTION

1. Field of the Invention

The present invention relates generally to multiple-cycle internal combustion engines and, more specifically, to a trainable, scavenger-ported piston with two and four-cycle capabilities.

2. Description of the Prior Art

There are other variable cycle pistons designed for internal combustion engines. Typical of these is U.S. Pat. No. 5,699,758 issued to John N. Clarke on Dec. 23, 1997.

Another patent was issued to Marius A. Paul et al. on May 21, 1996 as U.S. Pat. No. 5,517,951. U.S. Pat. No. 5,193,492 was issued on Mar. 16, 1993 to Hideo Kawamura. Yet another U.S. Pat. No. 5,007,382 was issued to Hideo Kawamura on Apr. 16, 1991.

A method for operating a reciprocating piston-type internal combustion engine selectively in two-stroke, four-stroke, and six-stroke mode includes; providing transfer valves, transfer passage means between piston cylinders, selectively controlling the actuation and timing of the intake, exhaust, and transfer valves, and alternatively operating the intake and exhaust valves for each piston cylinder in overlapping sequence during each crankshaft revolution to provide two-stroke operation, operating the intake and exhaust valves in sequence during each second crankshaft revolution to provide four-stroke operation, operating the intake, exhaust, and transfer valves sequentially to cause a secondary expansion stroke in an adjacent piston cylinder to provide six-stroke operation of the engine.

A universal internal combustion engine that is electronically and reversibly convertible from four-stroke operation to two-stroke operation, the engine having intake and exhaust valves with an electro-hydraulic actuator system for actuating the valves in accordance with electronic control signals from an electronic control module, the electro-hydraulic actuator system having an electronic actuator for each valve coupled to a slide valve for a discrete supply of pressurized hydraulic fluid to a hydraulic piston for each valve, the electronic control module having a program for independent activation of each electronic actuator for select operation of each intake and exhaust valve at any time during the operating cycle.

The present invention lies in a 2–4 cycle change-over engine and it=s control unit which perform 2 cycle running of the uniflow type by closing a suction valve at an upper portion of the engine and working a valve (a rotational sleeve) at a lower portion of a cylinder when the engine rotates in a lower number of revolution than a predetermined number of revolution and a load is larger than a predetermined value, and perform changeover into 4-cycle running by always closing a scavenging port at a lower portion of the cylinder by means of the valve (the rotational sleeve) at the lower portion of the cylinder and working the suction valve at the upper portion of the cylinder when a higher revolution than a predetermined number of revolution is given and an engine load is lighter than a predetermined load.

This cycle changeable engine includes first intake valves for a four-cycle operation which are disposed in intake ports formed in a cylinder head, exhaust valves disposed in exhaust ports, second intake valves for a two-cycle operation, disposed in intake ports formed at the lower part of a cylinder, and an electromagnetic valve driving device for opening and closing each of the valves by electromagnetic force. The engine includes also a controller which actuates either the first or second intake valves for opening and closing with the others being kept closed in response to a detection signal from detection means for detecting the number of revolutions or the load of the engine, and changes the operational condition of the engine to the two-cycle or four-cycle operation. In this manner the engine is operated in the two-cycle operation at a low speed revolution of the engine to improve an output torque and is operated in the four-cycle operation at a high-speed revolution of the engine to reduce fuel consumption, to improve mean effective pressure and volume efficiency and to While these variable-cycle engines may be suitable for the purposes for which they were designed, they would not be as suitable for the purposes of the present invention, as hereinafter described. For example, the prior art does not provide a variable-cycle engine that utilizes a rotating piston to selectively open and close the appropriate ports for the two-cycle and four-cycle modes, respectively.

SUMMARY OF THE PRESENT INVENTION

A primary object of the present invention is to provide an engine that can switch back and forth between two-cycle and four-cycle operational modes as needed due to a piston tail that rides along a training block within the cylinder wall. As the piston travels vertically the piston tail is training within a recess in the training block thereby rotating the piston head incrementally and aligning various ports to perform their respective functions.

Another object of the present invention is to provide a variable-cycle engine with a trainable piston that is governed by a microprocessor that adjust cycling according to load requirements picked up by sensors.

Yet another object of the present invention is to provide a variable-cycle engine with a trainable piston that utilizes cylinder porting, piston ports, and scavenging ports in the cylinder wall to supply fuel to the combustion chamber.

Still yet another object of the present invention is to provide a ball and socket means for attaching the connecting rod to the piston head thereby enabling the piston head to rotate when training.

Yet another object of the present invention is to provide a multiple-cycle engine that is efficient to operate yet can increase power capacity when necessary.

Additional objects of the present invention will appear as the description proceeds.

The present invention overcomes the shortcomings of the prior art by providing an internal combustion engine that can maintain the low weight, simplicity, and high power output of a two-cycle engine and switch over to a four-cycle operation for lower emissions and greater fuel economy when under normal operating conditions, by means of a computer-operated trainable piston assembly.

The present invention provides the means to maintain the low weight, simplicity and high power output of the two-cycle engine while under load, and yet maintain the lower emissions and higher increased economic requirements of the four-cycle engine under normal operating conditions. A ported, scavenging piston is connected to the crankshaft by means of a connecting rod, which has a ball-shaped (male) configuration on the upper end and links into the piston socket (female), which allows for the required multi-positioning of the piston. The connecting rod is linked to the crankshaft by means of a free spinning bearing.

When not under load, or at low RPM, the engine shall run in the four-cycle mode, by means of the trainable piston, which will be positioned by means of a training block, which is located within the cylinder wall. The piston is aligned by the training block by a piston tail that slides within the training block. The training block is computer controlled for two and four-cycle modes.

While in the four stroke mode the piston starts out in the upper position and travels down within the cylinder, being trained by means of the piston tail following the training block. A fuel charge is drawn through the piston from the intake port runner located in the cylinder wall, and travels through the piston port to the adjacent four-cycle scavenging port runner, and on into the combustion chamber. The piston is then trained counter-clockwise 35° by means of the training block, and starts it's upward travel for the compression stroke.

At full compression the spark plug fires causing detonation of the fuel and the piston travels down for the power stroke. The piston is again trained counter-clockwise 35° by means of the training block, and starts it's upward travel for the exhaust-purging stroke.

For the fourth and final cycle of the four-cycle mode, the piston is trained, by means of the training block, returning to the first position for the down and intake stroke.

Under a load or at a higher RPM where the two-cycle operation is self-sustaining because intake charge is scavenged by means of a megaphone exhaust at high RPM's, the piston is trained by means of the training block to a fourth position to align the intake runner and two-cycle scavage runner, and starts its downward motion. Again a fuel charge is drawn through the piston from the intake port runner located in the cylinder wall and travels through the piston port, this time in the opposite direction, to the adjacent two-cycle scavenging port runner, and on into the combustion chamber. The exhaust cycle occurs simultaneously. The piston is then trained to a fifth position so that all ports are sealed and begins its upward travel for the compression stroke. At full compression the spark plug fires causing detonation of the fuel and the piston travels down for the power stroke. The piston is then repeatedly moved between the fourth and fifth positions (intake/exhaust [Position 4] and power/compression [Position 5] of two-cycle operation).

Exhaust vents in the piston head allow for the variation in piston positioning for all operations of the two and four-cycle modes.

A variable-cycle engine capable of alternating between two-cycle and four-cycle operation is provided, comprising: a cylinder block having at least one piston cylinder and a piston reciprocable in the cylinder, the cylinder block further having a crankshaft and a connecting rod, the cylinder further having a training block, the training block being movable about the inner periphery of the cylinder; the connecting rod connecting the piston and the crankshaft such that the piston may rotate within the cylinder on the connecting rod; the piston having a top and a side; the piston further having a piston port, the piston port having a first end on the piston side and a second end on the piston side; the piston further having a first and second exhaust vent, each such exhaust vent having an exhaust intake end on the piston top and an exhaust discharge end on the piston side; the piston further having a tail member extending to and received by the training block such that the piston rotates within the cylinder as the training block moves; a training block driving assembly for causing the training block to sequentially and repeatedly move from a first to a second to a third position for four-cycle operation, and, alternatively for causing the training block to sequentially and repeatedly move from a fourth to a fifth position for two-cycle operation, the movement of the training block causing the piston to rotate into five rotation positions corresponding with the five positions of the training block; a fuel charge intake port alignable with the piston port first end, when the piston is in the first rotation position, such that the fuel charge is scavenged from the intake port into the piston port first end, such scavenging being terminated when the piston is in the second rotation position; a first scavage port positioned such that, when the piston is in the first rotation position, the piston port second end discharges the fuel charge into the first scavage port and the first scavage port discharges the fuel charge into the cylinder above the piston top, the first scavage port being further positioned such that the fuel charge discharge into the first scavage port is terminated when the piston is in the second rotation position; an exhaust port positioned for receiving exhaust from the piston first exhaust vent discharge end when the piston is in the third rotation position; and a second scavage port positioned such that, when the piston is in the fourth rotation position, the intake passage discharges the fuel charge into the piston port second end, the piston port first end discharges the fuel charge into the second scavage port, and the second scavage port discharges the fuel charge into the cylinder above the piston top, the second scavage port being further positioned such that the fuel charge discharge from the second scavage port terminates when the piston is in the fifth rotation position, the exhaust port, in this fifth rotation position, being aligned to receive exhaust from the piston second exhaust vent discharge end.

In another embodiment, the training block driving assembly further comprises at least one engine operational condition detector and a controller, the controller analyzing the detected engine operating conditions and adjusting training block movement in accordance with predetermined conditions necessitating such an adjustment.

In another embodiment, the controller includes a microprocessor.

In another embodiment, the training block driving assembly selects either two-cycle or four-cycle operation in response to at least one of the detectors measuring engine speed.

In another embodiment, the training block driving assembly selects either two-cycle or four-cycle operation in response to at least one of the detectors measuring engine load.

In another embodiment, the training block driving assembly selects either two-cycle or four-cycle operation in response to at least two of the detectors measuring engine load and speed, respectively.

In another embodiment, the training block driving assembly switches between two-cycle to four-cycle training block movement in response to an overriding manually entered input.

In another embodiment, the training block driving assembly utilizes electromagnetic forces for moving the training block.

In another embodiment, the training block driving assembly switches from two-cycle to four-cycle training block movement in response to manually entered input.

In another embodiment, the training block driving assembly utilizes electromagnetic forces for moving the training block.

In another embodiment, the connecting rod further comprises a ball, and the piston further comprises a socket for mating with the ball to form a ball and socket joint.

A variable-cycle engine capable of alternating between two-cycle and four-cycle operation is provided, comprising: a cylinder block having at least one piston cylinder and a piston reciprocable in the cylinder, the cylinder block further having a crankshaft and a connecting rod; the connecting rod connecting the piston and the crankshaft such that the piston may rotate within the cylinder on the connecting rod; the piston having a top and a side; the piston further having a piston port, the piston port having a first end on the piston side and a second end on the piston side; the piston further having a first and second exhaust vent, each such exhaust vent having an exhaust intake end on the piston top and an exhaust discharge end on the piston side; means for sequentially and repeatedly training the piston from a first to a second to a third rotation position for four-cycle operation, and, alternatively, for sequentially and repeatedly the piston from a fourth to a fifth rotation position for two-cycle operation; a fuel charge intake port alignable with the piston port first end, when the piston is in the first rotation position, such that the fuel charge is scavenged from the intake port into the piston port first end, such scavenging being terminated when the piston is in the second rotation position; a first scavage port positioned such that, when the piston is in the first rotation position, the piston port second end discharges the fuel charge into the first scavage port and the first scavage port discharges the fuel charge into the cylinder above the piston top, the first scavage port being further positioned such that the fuel charge discharge into the first scavage port is terminated when the piston is in the second rotation position; an exhaust port positioned for receiving exhaust from the piston first exhaust vent discharge end when the piston is in the third rotation position; and a second scavage port positioned such that, when the piston is in the fourth rotation position, the intake passage discharges the fuel charge into the piston port second end, the piston port first end discharges the fuel charge into the second scavage port, and the second scavage port discharges the fuel charge into the cylinder above the piston top, the second scavage port being further positioned such that the fuel charge discharge from the second scavage port terminates when the piston is in the fifth rotation position, the exhaust port, in this fifth rotation position, being aligned to receive exhaust from the piston second exhaust vent discharge end.

In another embodiment, the means for training the piston comprises at least one engine operational condition detector and a controller, the controller analyzing the detected engine operating conditions and adjusting piston training in accordance with predetermined conditions necessitating such an adjustment.

A variable-cycle engine capable of alternating between two-cycle and four-cycle operation is provided, comprising: a cylinder block having at least one piston cylinder and a piston reciprocable in the cylinder, the cylinder block further having a crankshaft and a connecting rod, the cylinder further having a training block, the training block being movable about the inner periphery of the cylinder; the connecting rod further having a ball and the piston further having a socket for mating with the ball to form a ball and socket joint, such that the piston may rotate within the cylinder on the connecting rod; the piston having a top and a side; the piston further having a piston port, the piston port having a first end on the piston side and a second end on the piston side; the piston further having a first and second exhaust vent, each such exhaust vent having an exhaust intake end on the piston top and an exhaust discharge end on the piston side; the piston further having a tail member extending to and received by the training block such that the piston rotates within the cylinder as the training block moves; a detector for detecting the operational conditions of the engine; at least one sensor for detecting engine speed and engine load, and a microprocessor, the microprocessor analyzing the sensed engine operating conditions; a training block driving assembly for receiving signals from the microprocessor and selectively causing the training block to sequentially and repeatedly move from a first to a second to a third position for four-cycle operation, and, alternatively, for selectively causing the training block to sequentially and repeatedly move from a fourth to a fifth position for two-cycle operation, the movement of the training block causing the piston to rotate into five rotation positions corresponding with the five positions of the training block, the microprocessor signals causing the training block driving assembly to move the training block movement in accordance with predetermined conditions necessitating such movement; a fuel charge intake port alignable with the piston port first end, when the piston is in the first rotation position, such that the fuel charge is scavenged from the intake port into the piston port first end, such scavenging being terminated when the piston is in the second rotation position; a first scavage port positioned such that, when the piston is in the first rotation position, the piston port second end discharges the fuel charge into the first scavage port and the first scavage port discharges the fuel charge into the cylinder above the piston top, the first scavage port being further positioned such that the fuel charge discharge into the first scavage port is terminated when the piston is in the second rotation position; an exhaust port positioned for receiving exhaust from the piston first exhaust vent discharge end when the piston is in the third rotation position; and a second scavage port positioned such that, when the piston is in the fourth rotation position, the intake passage discharges the fuel charge into the piston port second end, the piston port first end discharges the fuel charge into the second scavage port, and the second scavage port discharges the fuel charge into the cylinder above the piston top, the second scavage port being further positioned such that the fuel charge discharge from the second scavage port terminates when the piston is in the fifth rotation position, the exhaust port, in this fifth rotation position, being aligned to receive exhaust from the piston second exhaust vent discharge end.

A method for alternating between two-cycle and four-cycle operation of an internal combustion engine is provided, comprising the steps of: connecting a piston to a crankshaft such that the piston is rotatable within a cylinder and reciprocable within the cylinder; positioning the piston in a first rotation position such that a fuel charge intake port scavenges a fuel charge from a piston port first end, then out a piston port second end, then into a first scavage port runner, then into a combustion chamber; positioning the piston in a second rotation position such that the combustion chamber is sealed for compression and ignition; positioning the piston in a third rotation position such that the exhaust from the ignition enters a first piston exhaust vent, then exits the first piston exhaust vent into a cylinder exhaust port, and then exits the cylinder; for two-cycle positioning the piston in a fourth rotation position such a fuel charge intake port scavenges a fuel charge from a piston port second end, intake charge is scavenged by a megaphone type exhaust then out a piston port first end, then into a second scavage port runner, then into a combustion chamber, while, simultaneously, exhaust enters a second piston exhaust vent, then exits the second piston exhaust vent into the cylinder exhaust port, and then exits the cylinder; and positioning the piston in a fifth rotation position such that the combustion chamber is sealed for combustion and ignition.

In another embodiment, the method further comprises the step of switching between two-cycle and four-cycle operation in response to measured engine operating conditions.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and the structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings.

FIG. 1 is sectional side view of the present invention during operation. Shown is a crankshaft contained within a wet sump crankcase and rotating counter-clockwise. Attached to the camshaft by a free-spinning bearing is the connecting rod assembly that uses a ball and socket method to fasten to an interior portion of the piston cylinder head to provide for the vertical and rotational movement of the piston head. Fuel is introduced to the combustion chamber through a series of intake runners and exhaust is expelled through the piston exhaust port, piston exhaust vents and piston scavenging ports that align at predetermined points as the piston head moves vertically within the cylinder and rotates horizontally. Horizontal rotation of the piston head is achieved by a piston tailpiece that extends down vertically along the cylinder wall from the piston head to a training block mechanism integrated within the cylinder wall. A training block extends horizontally from the lower end of the piston tailpiece and rides along a groove in the training block to align the aforementioned ports.

FIG. 2 is an exploded isometric view of the ported piston head and connecting rod assembly. Shown are a curved horizontal intake piston port and vertical exhaust vents located within the piston head. The connecting rod attaches to the piston head utilizing a ball and socket joint to permit the piston head to rotate simultaneously as the crankshaft oscillates the lower portion of the connecting rod, and as the piston is trained by the training block.

FIG. 3 is a partial sectional perspective view of the ported piston head used for the variable-cycle training having two exhaust vents—one for two-cycle and one for four-cycle. The exhaust vents are ported from the top side accessing the combustion chamber and the side of the piston head where each can communicate with the exhaust port located in the cylinder block. The tailpiece is contained within the training block and slides freely when traveling vertically. The training block rotates within the cylinder block and guides the tailpiece along with it thereby effectively rotating the piston to align the ports as necessary.

FIG. 4 a top view of the piston head showing the port configuration during the lower stage of the intake stroke when in Position 1 of the four-cycle mode. Shown is the fuel entering the intake port runner, passing through the piston port where it is then deflected by the four-cycle scavenger port runner located in the cylinder wall, and then into the combustion chamber.

FIG. 4A of intake position 1 is a front sectional view of the piston head showing the piston operation during the lower stage of the intake stroke when in Position 1 of the four-cycle mode. Shown is the piston tailpiece with training guide riding within the training block.

FIG. 5 is a top view of the piston head rotated 90 degrees clockwise from FIG. 4 showing the port configuration during the lower stage of the intake stroke when in Position 1 of the four-cycle mode. Shown is the fuel entering the intake port runner, passing through the piston port where it is then deflected by the four-cycle scavenger port runner located in the cylinder wall, and into the combustion chamber.

Figure 8:
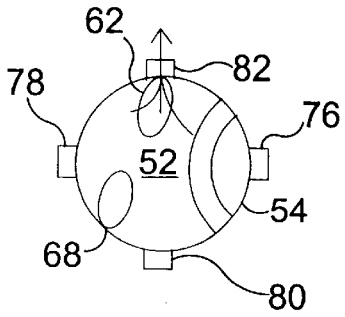

FIG. 8 is a top view of the piston head showing the port configuration during the lower stage of the exhaust stroke when in Position 3 of the four-cycle mode. The piston is trained 35 degrees counterclockwise from Position 2 and 70 degrees from Position 1. The four-cycle exhaust vent in the piston head is aligned with the port and the exhaust is expelled from the combustion chamber.

Figure 8A:
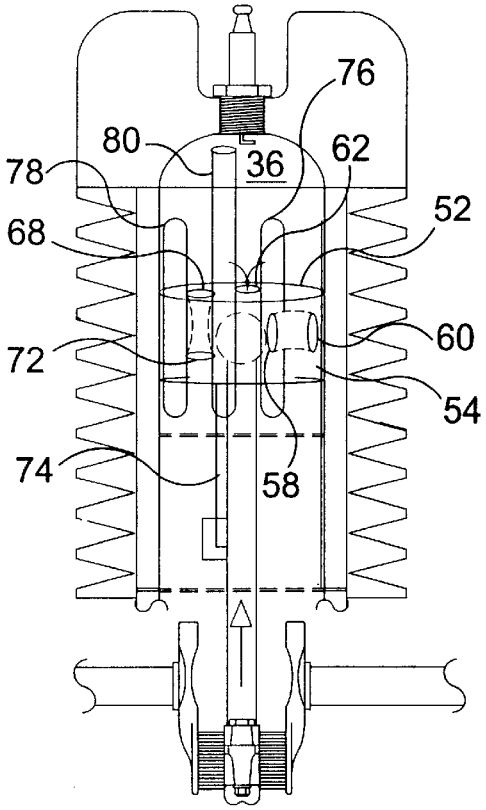

FIG. 8A is a sectional front view of the cylinder block during the lower stage of the exhaust stroke. The piston is trained 35 degrees counterclockwise from Position 2. The four-cycle exhaust vent in the piston head is aligned with the exhaust port and the exhaust is expelled from the combustion chamber.

Figure 9:
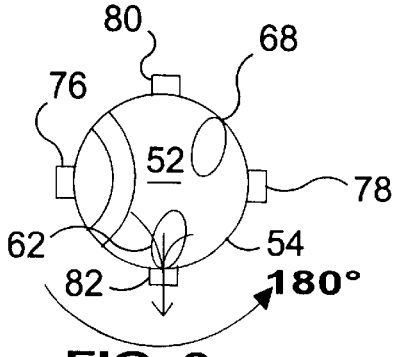

FIG. 9 is a top view of the piston head rotated approximately 180 degrees from FIG. 8 showing the port configuration during the lower stage of the exhaust stroke when in Position 3 of the four-cycle mode. The piston is trained 35 degrees counterclockwise from Position 2. The exhaust vent in the piston head is aligned with the exhaust port and the exhaust is expelled from the combustion chamber.

Figure 9A:
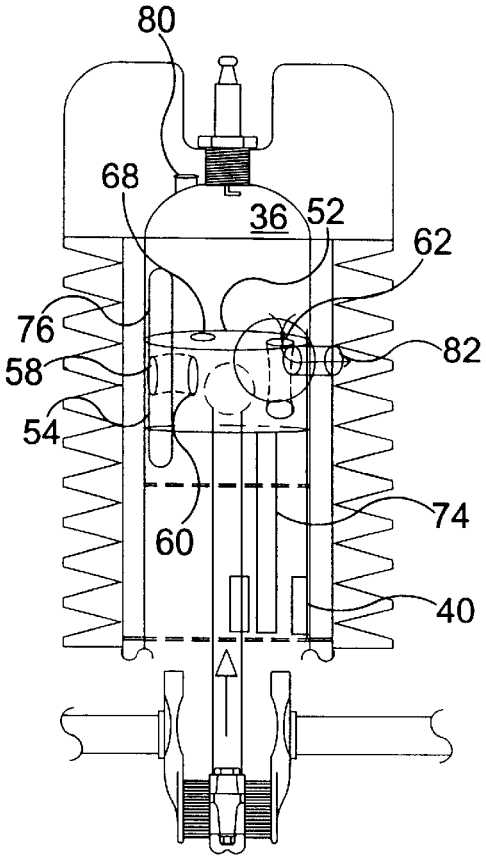

FIG. 9A is a sectional rear view of the cylinder block during the lower stage of the exhaust stroke. The piston is trained 35 degrees counterclockwise from Position 2. The four-cycle exhaust vent in the piston head is aligned with the exhaust port and the exhaust is expelled from the combustion chamber.

Figure 10:
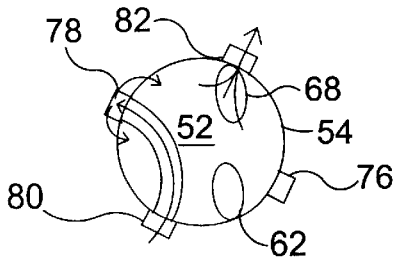

FIG. 10 is a top view of the piston head showing the port configuration during the upper stage of the intake/exhaust stroke when in Position 4, i.e. the starting position of the two-cycle mode. The piston is trained 90 degrees clockwise from Position 1. The fuel charge is entering the combustion chamber via the intake runner, piston and two-cycle scavenger port. The exhaust port is exposed to the two-cycle exhaust vent and exhaust is expelled out of the combustion chamber simultaneous to fuel intake occurring.

Figure 10A:
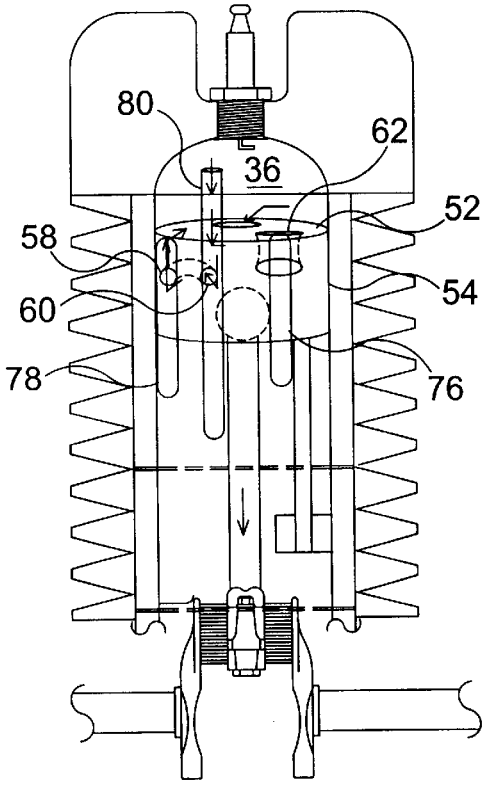

FIG. 10A is a sectional front view of the cylinder block during the upper stage of the intake/exhaust stroke. The piston is trained 90 degrees clockwise from Position 1. Shown is the charge entering the combustion chamber.

Figure 11:
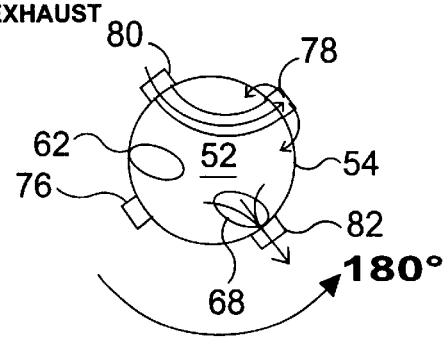

FIG. 11 is a top view of the piston head showing the port configuration during the upper stage of the intake/exhaust stroke when in Position 4 of the two-cycle mode, rotated 180 degrees from FIG. 10. The piston is trained 90 degrees clockwise from Position 1.

Figure 11A:
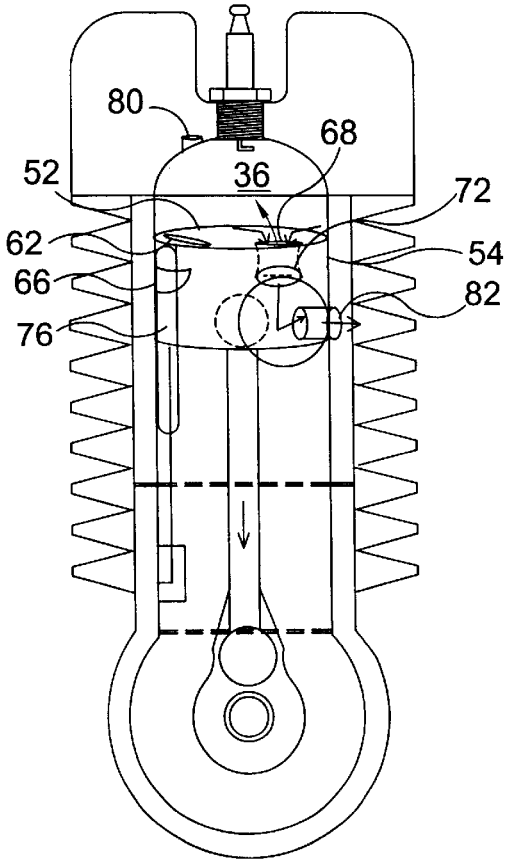

FIG. 11A is a sectional front view of the cylinder block during the upper stage of the intake/exhaust stroke. The piston is trained 90 degrees clockwise from Position 1. Shown is the exhaust entering the exhaust two-cycle exhaust vent in the piston head as it is aligned with the exhaust port and the exhaust is expelled from the combustion chamber. This occurs simultaneous to fuel intake and fuel intake is scavenged by suction caused by megaphone type exhaust at high RPM.

Figure 12:
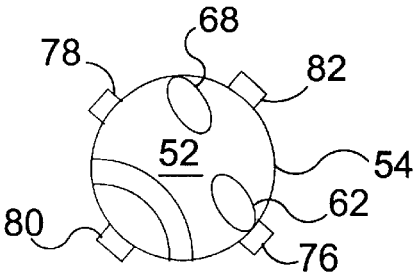

FIG. 12 is a top view of the piston head showing the port configuration during the upper stage of the compression/power two-cycle stroke when in Position 5 of two-cycle mode. The piston is trained 35 degrees counterclockwise from Position 4.

Figure 12A:
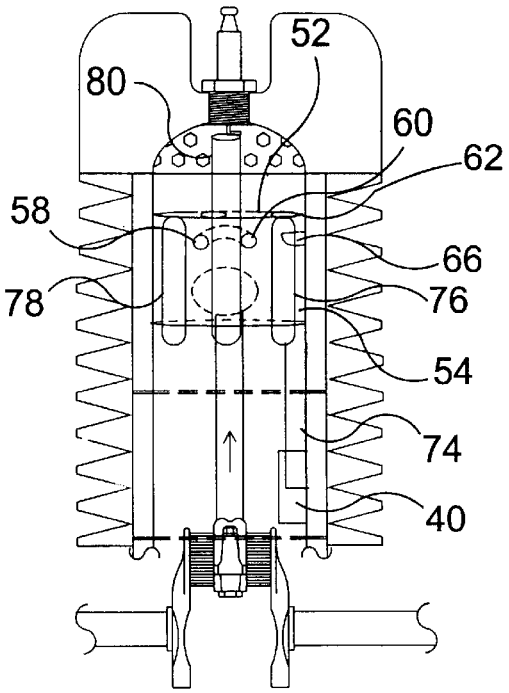

FIG. 12A is a sectional front view of the cylinder block during the upper stage of the compression/power two-cycle stroke. The piston is trained 35 degrees counterclockwise from Position 4. Shown also is the required non-alignment of ports to seal the combustion chamber.

Figure 13:
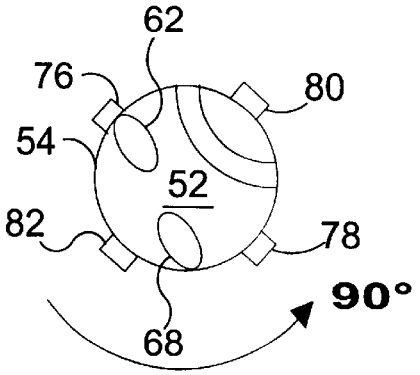

FIG. 13 is a top view of the piston head showing the port configuration during the upper stage of the compression/power two-cycle stroke when in Position 5 of the two-cycle mode. The view is rotated 180 degrees from FIG. 12. The piston is trained 35 degrees counterclockwise from Position 4.

Figure 13A:
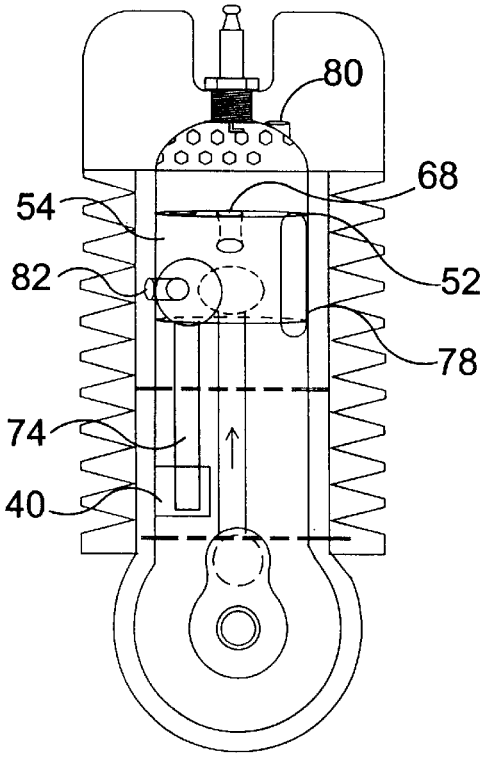

FIG. 13A is a sectional side view of the cylinder block during the upper stage of the compression/power two-cycle mode. As in Position 2 of the four-cycle mode, the training block has trained the piston 35 degrees counterclockwise from Position 4 to Position 5 to seal the combustion chamber which is fully charged and the spark plug is ready to fire. At the time of firing, and downward piston travel, the piston will be trained back clockwise 35 degrees to Position 4 intake/exhaust mode. It will continue to move between Position 4 and Position 5 for two-cycle operation.

Figure 14:
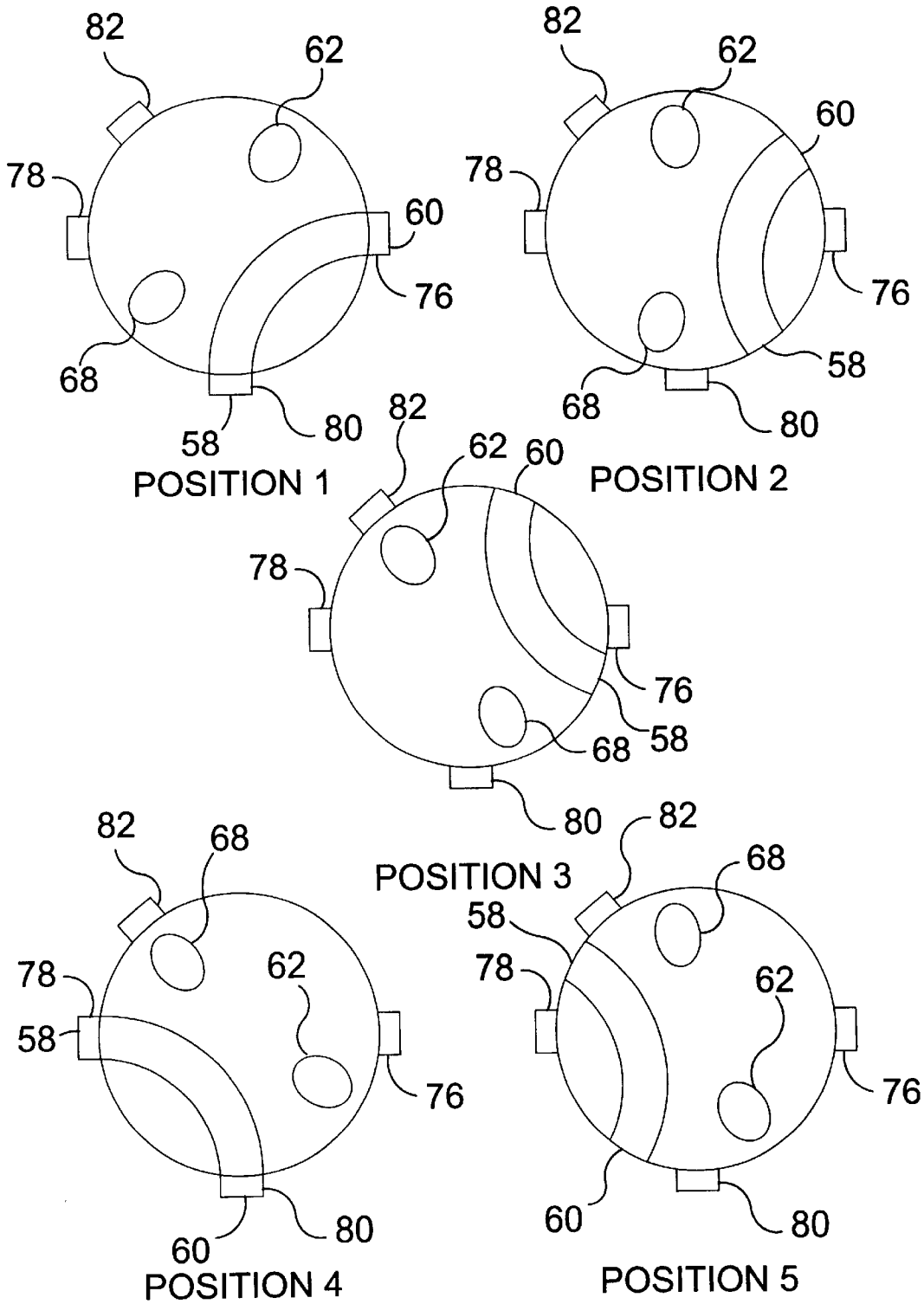

FIG. 14 is a combined top view of the piston wherein the five rotational positions of the piston are shown for the preferred embodiment.

Figure 15:
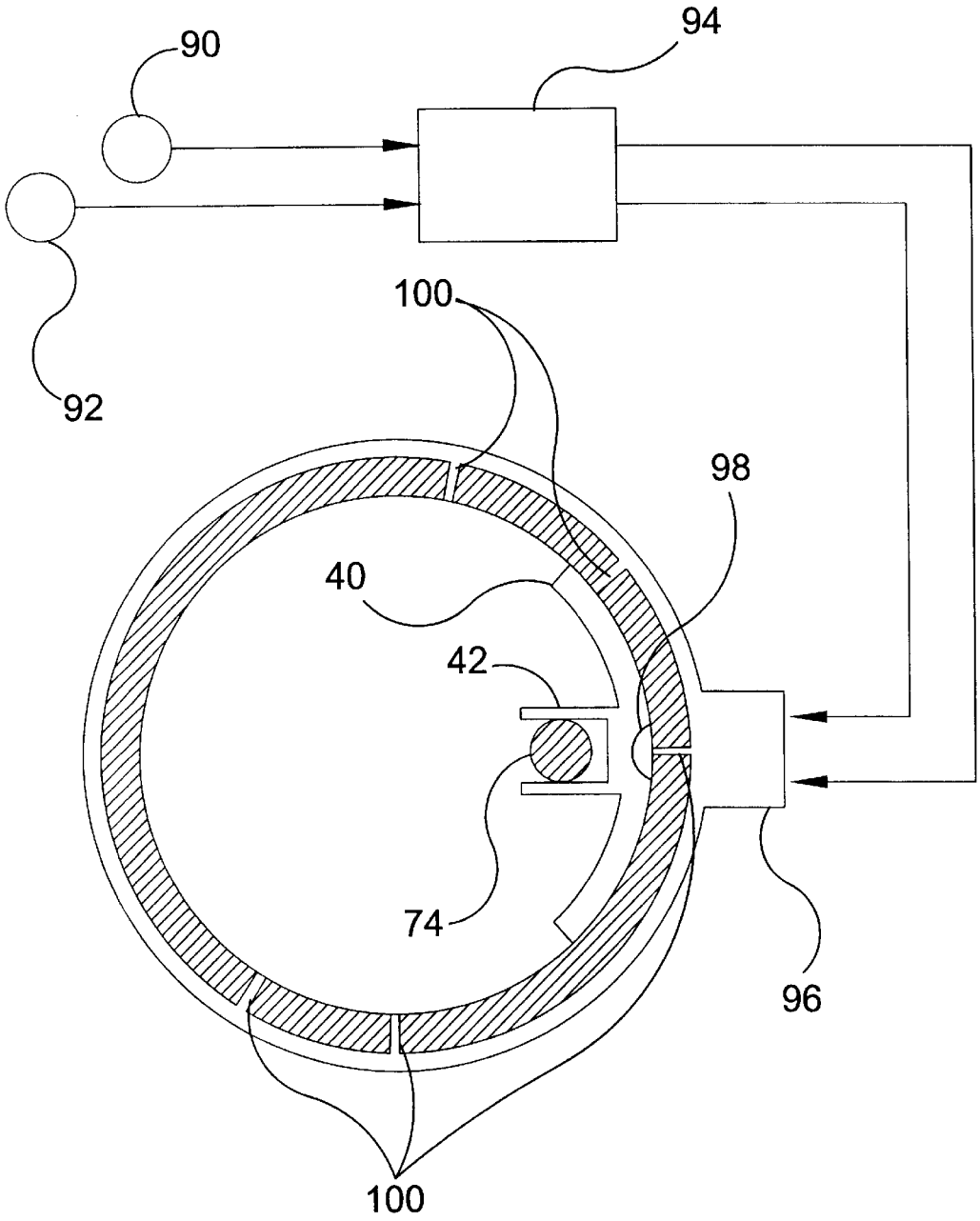

FIG. 15 is a symbolic illustration of electromagnetic apparatus used to rotate the training block.

DESCRIPTION OF THE REFERENCED NUMERALS

Turning now descriptively to the drawings, in which similar reference characters denote similar elements throughout the several views, the figure illustrate the Multi-Cycle Trainable Piston Engine of the present invention. With regard to the reference numerals used, the following numbering is used throughout the various drawing figures.

20 Multi-Cycle Trainable Piston Engine of the present invention
22 cylinder block
24 cylinder head
26 spark plug
28 crankcase
30 crankshaft
32 connecting rod
34 connecting rod ball
36 combustion chamber
40 training block
42 training block piston retention member
44 training block cylinder groove
50 piston
52 piston top
54 piston side
56 piston socket
58 piston port first end
60 piston port second end
62 piston first exhaust vent
64 piston first exhaust vent intake end
66 piston first exhaust vent discharge end
68 piston second exhaust vent
70 piston second exhaust vent intake end
72 piston second exhaust vent discharge end
74 piston tail
76 first scavage port runner
78 second scavage port runner
80 fuel charge intake port runner
82 exhaust port
90 detector for engine rpm
92 detector for engine load
94 controller
96 driving motor
98 training block cooperative displacement member
100 cylinder cooperative displacement member

DETAILED DESCRIPTION OF THE PREFERRED EMBODIMENTS

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1–15 illustrate the Multi-Cycle Trainable Piston Engine and its individual features, the engine indicated generally by the numeral 20.

Figure 1:
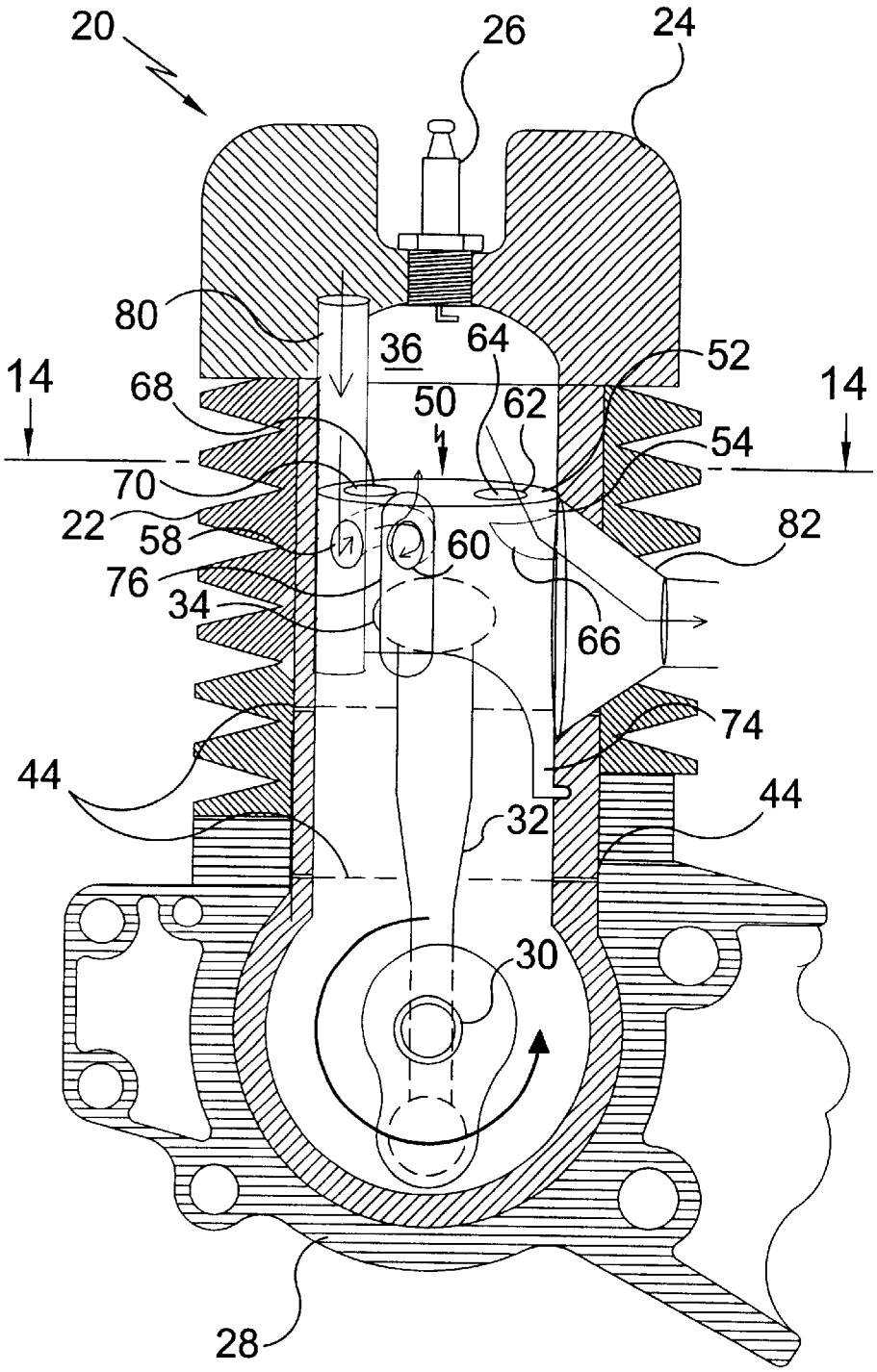

As shown in FIG. 1, the engine 20 includes a cylinder block 22, a cylinder head 24, a spark plug 26 for each cylinder, a crankcase 28, a crankshaft 30, a connecting rod 32 having a connecting rod ball 34, and a combustion chamber 36. Positioned within the cylinder for movement along the cylinder's inner periphery is a training block 40 having a piston retention member 42, the training block 40 moving within grooves 44.

Figure 2:
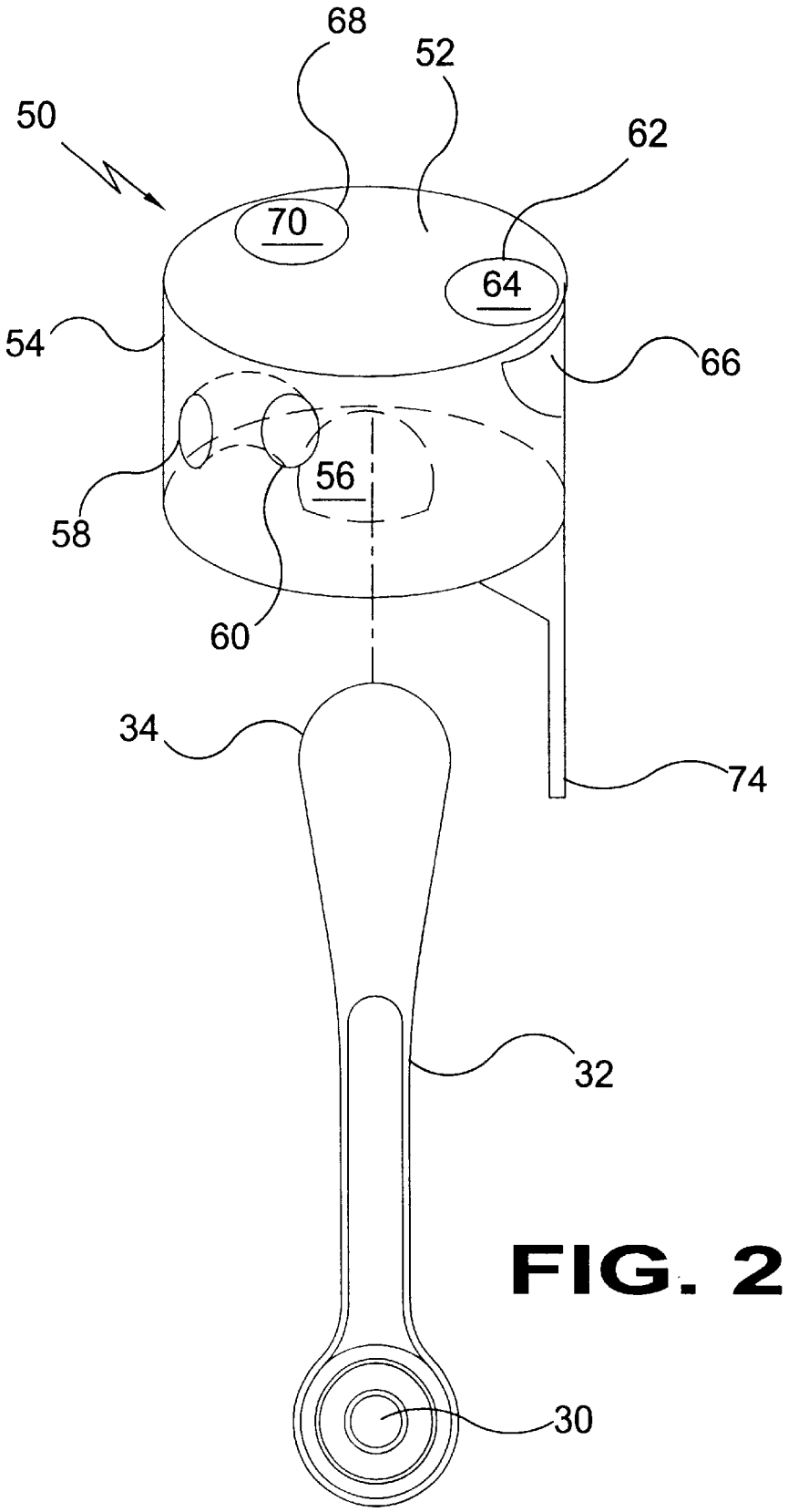
Figure 3:
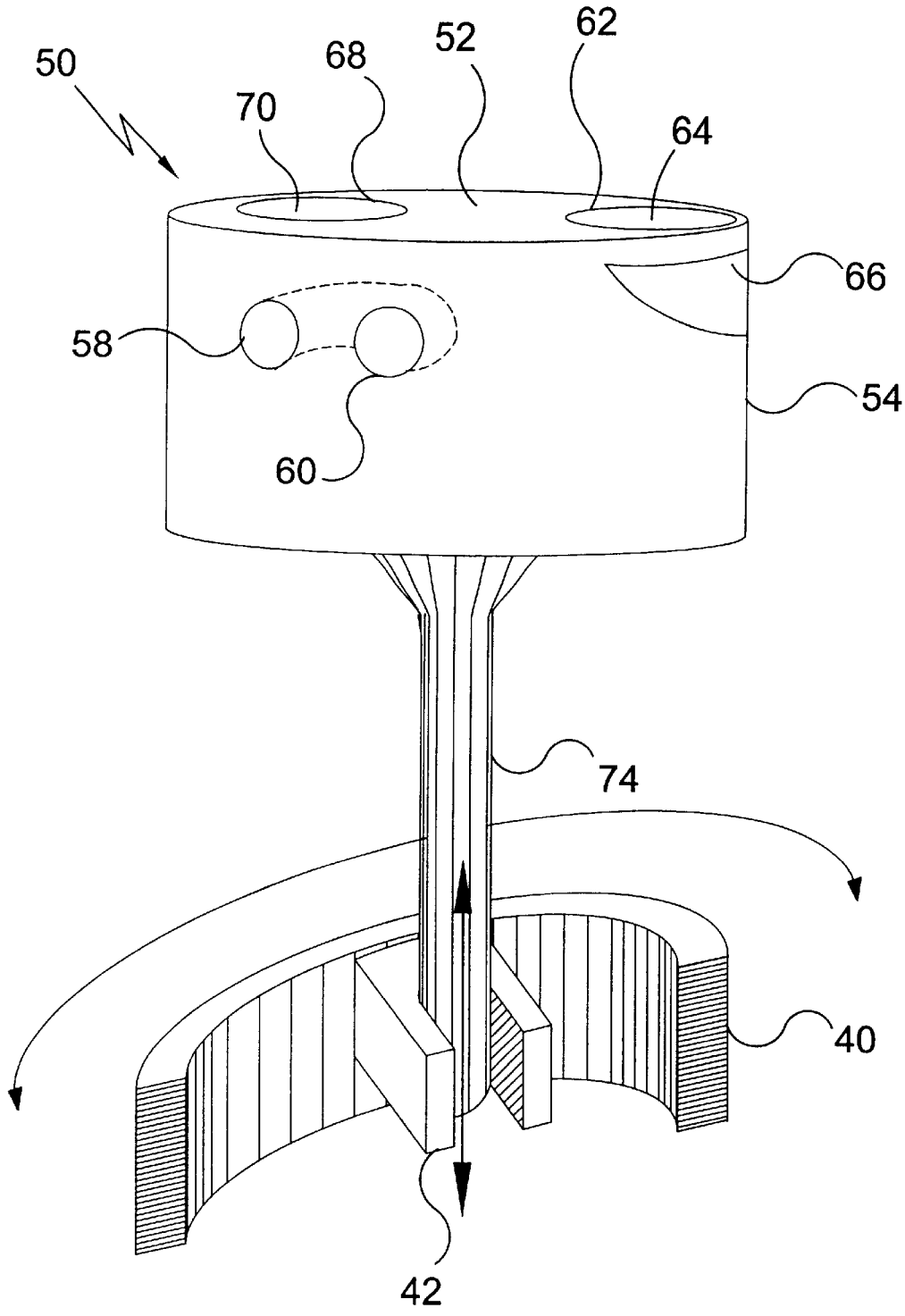

Within each cylinder is a piston 50, having a top 52, side 54, socket 56 for mating with the connecting rod ball 34, piston port first end 58, piston port second end 60, first exhaust vent 62 having an intake end 64 and a discharge end 66, second exhaust vent 68 having an intake end 70 and a discharge end 72, and a tail 74 that extends downwardly for lateral retention by the training block retention member 42, such that peripheral movement of the training block 40 within its grooves 44 causes the piston 50 to rotate within the cylinder. FIG. 2 depicts the piston 50 while FIG. 3 illustrates the mating of the training block retention member 42 with the piston tail 74.

The engine 20 has a first scavage port runner 76, a second scavage port runner 78, a fuel charge intake port runner 80 and an exhaust port 82, for varying alignment with the features of the piston 50, depending on its rotational position.

For four-cycle performance, the training block 40 moves sequentially and repeatedly from a first position to a second position to a third position and back to the first position to start again. The piston 50 is trained to three corresponding positions as the training block retention member 42 displaces the piston tail 74. The three piston 50 configurations for these three rotational positions are shown collectively in FIG. 14, as Position 1, Position 2, and Position 3. FIG. 14 represents the preferred embodiment, while the rotational positions of another embodiment are shown in FIGS. 4–13A.

The training block 40 movement is accomplished using conventional means and can be accomplished using the electromagnetic driving principles shown by Kawamura, in U.S. Pat. No. 5,193,492, wherein a sleeve on the cylinder's outer periphery is rotated by electromagnetic forces, using a driving motor and magnets placed about the cylinder periphery. As shown in his FIG. 1, Kawamura uses a controller with a microcomputer to power and instruct the driving motor. First, a revolution sensor and a load sensor communicate engine operational conditions to the controller wherein the microcomputer determines whether four-cycle or two-cycle operation is desired under predetermined values for engine speed and engine load. The controller then instructs and enables the driving motor to rotate the peripheral sleeve, which, in the Kawamura engine acts as a valve, and causes the engine to change from the two-cycle to the four-cycle mode, or from the four-cycle to the two-cycle mode. The Kawamura patent is incorporated herein by reference for all purposes.

FIG. 15 symbolically illustrates an analogous arrangement for the engine 20 of the present invention, wherein the training block 40 is moved instead of a rotational sleeve. An engine speed detector 90 and an engine load detector 92 send information to a controller 94 for an analysis of two-cycle versus four-cycle desirability. The controller 94 enables and instructs a driving element 96 that, in turn, electromagnetically causes the training block displacement member 98 and the various cylinder displacement members 100 to cooperate and move the training block 40 to the appropriate position to initiate two or four-cycle operation, as the case may be. The cylinder displacement members 100, when aligned with the training block displacement member 98, will position the training block in the five required positions.

The controller 94 also changes the spark plug 26 firing pattern as needed to accommodate the chosen engine 20 operation mode. (The illustrations of the controller 94, the driving member 96, and the displacement members 98,100 are representative only.).

As shown in FIG. 14 for Position 1, the piston port first end 58 is adjacent the intake port runner 80 for receiving the fuel charge and discharging it from the piston port second end 60 into the adjacent first scavage port runner 76. The first scavage port runner 76, in turn, discharges the fuel charge into the combustion chamber 36. The fuel charge entry occurs as the piston 50 is moving downward. In this second position, the piston first and second exhaust vents 62 and 68 are adjacent the cylinder wall, and the exhaust port 82 is against the piston side 54, such that the fuel charge has no escape from the combustion chamber 36.

As the piston 50 begins the upstroke to compress the fuel charge, the training block 40 moves to its second position and the piston 50 is trained to its second rotational position. In Position 2, approximately 35 degrees in a counterclockwise direction from Position 1, the piston port first and second ends 58,60 are adjacent cylinder walls. The piston exhaust vents 62,68 are not in communication with the exhaust port 82, so the combustion chamber 36 is sealed for upstroke compression and spark plug 26 firing. Upon firing the piston 50 is again moving downwardly in the power stroke.

The training block 40 is then moved to its third position, which is about 70 degrees from Position 1 in the counterclockwise direction. The piston 50 is trained to Position 3, its third rotational position, as shown in FIG. 14. In this position, the piston first exhaust vent 62 is adjacent the exhaust port 82, and as the piston 50 strokes upward, the exhaust is expelled through the first exhaust vent 62 and the exhaust port 82.

The exhaust stroke completes the four-cycle operation, and the piston 50 is then trained by the training block 40 to Position 1, the first rotational position, to again be ready to receive the a fuel charge from the intake port runner 80 on the subsequent downstroke.

Two-cycle performance is illustrated by Position 4 and Position 5 on FIG. 14. For two-cycle performance, the training block 40 repeatedly moves between a fourth position and a fifth position. The piston 50 is trained to two corresponding positions, Position 4 and Position 5, as the training block retention member 42 displaces the piston tail 74.

After receiving information that engine 20 operating conditions warrant two-cycle operation, the training block 40 is moved to its fourth position and the piston 50 is trained to Position 4. Position 4 is approximately 90 degrees clockwise from Position 1.

The two-cycle operation starts with a downstroke while in this fifth rotational position. The intake port runner 80 now feeds a fuel charge to the piston port second end 60 where it is then scavenged to the piston port first end 58 into the second scavage port runner 78, and, in turn, into the combustion chamber 36. Unlike other two-cycle engines, the fuel charge is scavenged in by the suction of the existing exhaust gases trailing through the piston second exhaust vent 68. The exhaust enters the piston second exhaust vent intake end 70 and discharges from the piston second exhaust vent discharge end 72 into the exhaust port 82.

To begin the upstroke, intake charge is scavenged by a megaphone type exhaust, the training block 40 is moved to its fifth position, and the piston 50 is trained to its fifth rotational position, Position 5. Position 5 is about 35 degrees clockwise from Position 4, and 120 degrees clockwise from Position 1. As the piston 50 moves upward the fuel charge is compressed since the piston port first and second ends 58,60 are adjacent the cylinder wall. When the spark plug 26 fires and the piston 50 is moved downward, the training block 40 moves to its fourth position again, and the piston 50 is trained to Position 4, thus allowing the intake and exhaust functions to be repeated as a new two-cycle operation begins.

Figure 4:
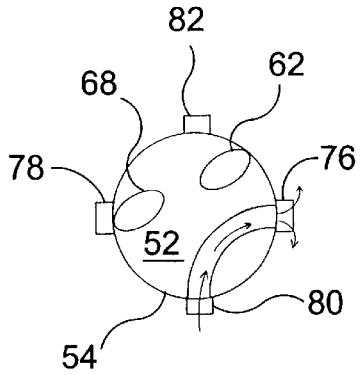
Figure 5:
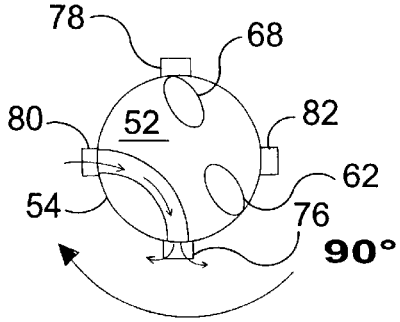
FIG. 5A is a side sectional view of the piston cylinder showing the position operation during the lower stage of the intake stroke when in Position 1 of the four-cycle mode. Shown is fuel transference from intake port runner through the piston port into the scavenging port runner before reaching the combustion chamber.
Figure 4A:
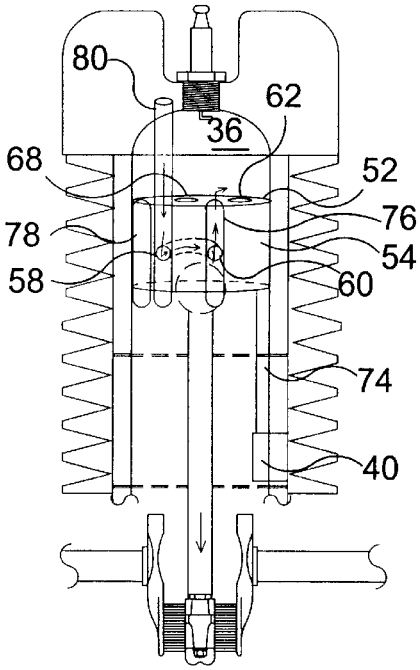
Figure 5A:
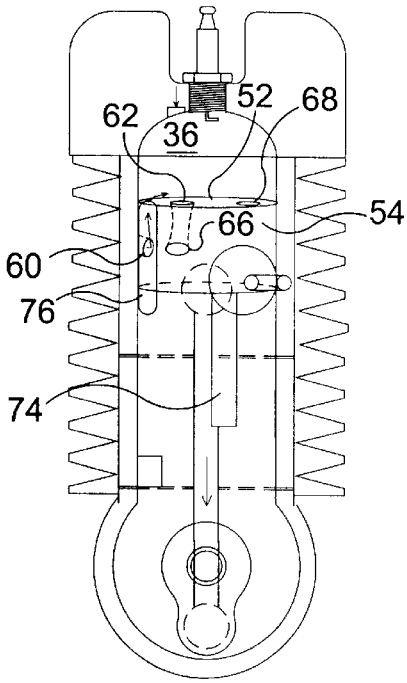
Figure 6:
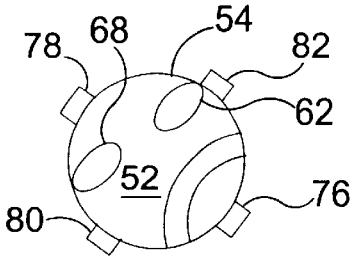
FIG. 6 is a top view of the piston head showing the port configuration during the upper stage of the compression/power stroke when in Position 2 of the four-cycle mode. Shown is a non-alignment of all ports to seal the combustion chamber.
Figure 7:
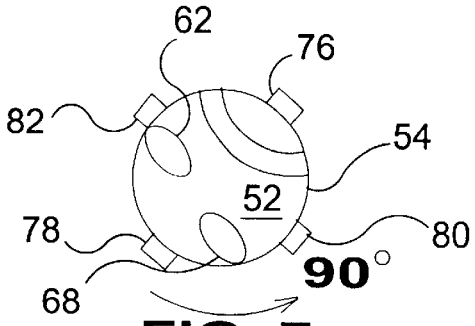
FIG. 7 is a top view of the piston head, rotated 90 degrees counterclockwise from FIG. 6, showing the port configuration during the upper stage of the compression/power stroke when in Position 2 of the four-cycle mode. All ports are non-aligned and the combustion chamber is sealed.
Figure 6A:
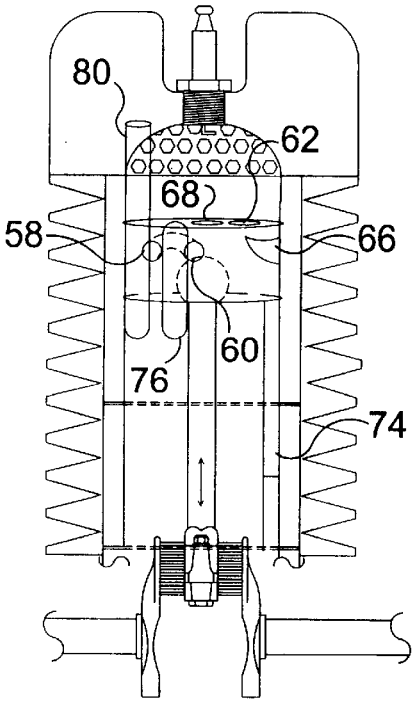
FIG. 6A is a front sectional view of the piston cylinder showing the piston operation during the upper stage of the compression/power stoke when in Position 2 of the four-cycle mode. The training block has trained the piston 35 degrees counterclockwise from Position 1 to seal the combustion chamber that is fully charged and the spark plug is ready to fire.
Figure 7A:
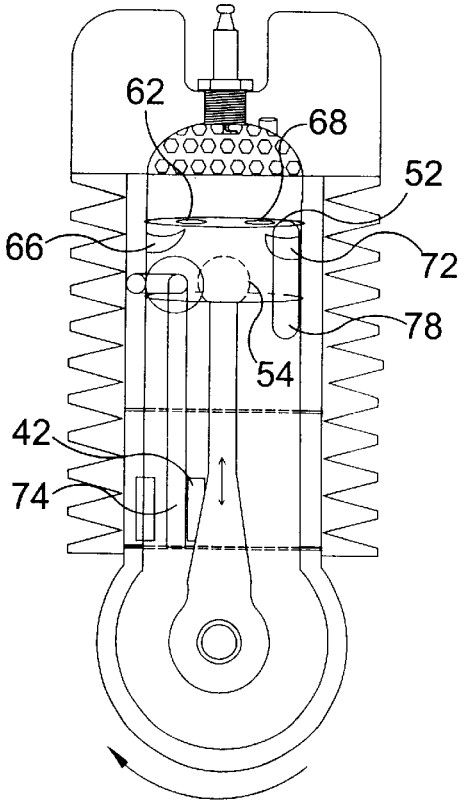
FIG. 7A is a sectional side view of the piston cylinder during the upper stage of the compression/power stroke when in position 2 of the four-cycle mode. The spark plug is about to fire to ignite the charge in the combustion chamber to force the piston down and turn the crankshaft.

The embodiment shown in FIGS. 4–13A has a different planar view arrangement of the piston first and second exhaust vents 62,68 and the exhaust port 82. For this embodiment, FIGS. 4–5A illustrate Position 1, FIGS. 6–7A illustrate Position 2, FIGS. 8–9A illustrate Position 3, FIGS. 10–11A illustrate Position 4, and FIGS. 12–13A illustrate Position 5.

The present invention encompasses the manual switching of the engine 20 between four-cycle and two-cycle operation.

With respect to the above description then, it is to be realized that the optimum material and dimensional relationships for the parts of the engine, to include variations in size, materials, shape, form, and numbers of pistons, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A variable-cycle engine capable of alternating between two-cycle and four-cycle operation, comprising:

a cylinder block having at least one piston cylinder and a piston reciprocable in the cylinder, the cylinder block further having a crankshaft and a connecting rod, the cylinder further having a training block, the training block being movable about the inner periphery of the cylinder;

the connecting rod connecting the piston and the crankshaft such that the piston may rotate within the cylinder on the connecting rod;

the piston having a top and a side;

the piston further having a piston port, the piston port having a first end on the piston side and a second end on the piston side;

the piston further having a first and second exhaust vent, each such exhaust vent having an exhaust intake end on the piston top and an exhaust discharge end on the piston side; the piston further having a tail member extending to and received by the training block such that the piston rotates within the cylinder as the training block moves;

a training block driving assembly for causing the training block to sequentially and repeatedly move from a first to a second to a third position for four-cycle operation, and, alternatively, for causing the training block to sequentially and repeatedly move from a fourth to a fifth position for two-cycle operation, the movement of the training block causing the piston to rotate into five rotation positions corresponding with the five positions of the training block;

a fuel charge intake port alignable with the piston port first end, when the piston is in the first rotation position, such that the fuel charge is scavenged from the intake port into the piston port first end, such scavenging being terminated when the piston is in the second rotation position;

a first scavage port positioned such that, when the piston is in the first rotation position, the piston port second end discharges the fuel charge into the first scavage port and the first scavage port discharges the fuel charge into the cylinder above the piston top, the first scavage port being further positioned such that the fuel charge discharge into the first scavage port is terminated when the piston is in the second rotation position;

an exhaust port positioned for receiving exhaust from the piston first exhaust vent discharge end when the piston is in the third rotation position; and a second scavage port positioned such that, when the piston is in the fourth rotation position, the fuel charge is scavenged from the intake passage into the piston port second end, intake and exhaust happening simultaneously, the piston port first end discharges the fuel charge into the second scavage port, and the second scavage port discharges the fuel charge into the cylinder above the piston top and exhaust port being aligned to receive exhaust from the piston second exhaust vent discharge end, the second scavage port being further positioned such that the fuel charge discharge from the second scavage port terminates when the piston is in the fifth rotation position, fifth position compression/ignition position, in this fifth rotation position all ports are closed and compression ignition occurs.

2. The engine of claim 1, wherein intake/exhaust and compression/ignition cycles between fourth and fifth position, the training block driving assembly further comprises at least one engine operational condition detector and a controller, the controller analyzing the detected engine operating conditions and adjusting training block movement in accordance with predetermined conditions necessitating such an adjustment.

3. The engine of claim 2, wherein the controller includes a microprocessor.

4. The engine of claim 2, wherein the training block driving assembly selects either two-cycle or four-cycle operation in response to at least one of the detectors measuring engine speed.

5. The engine of claim 2, wherein the training block driving assembly selects either two-cycle or four-cycle operation in response to at least one of the detectors measuring engine load.

6. The engine of claim 2, wherein the training block driving assembly selects either two-cycle or four-cycle operation and will vary the amount the port is open to control port size in response to at least two of the detectors measuring engine load and speed, respectively.

7. The engine of claim 2, wherein the training block driving assembly switches between two-cycle to four-cycle training block movement in response to an overriding manually entered input.

8. The engine of claim 2, wherein the training block driving assembly utilizes electromagnetic forces for moving the training block.

9. The engine of claim 1, wherein the training block driving assembly switches from two-cycle to four-cycle training block movement in response to manually entered input.

10. The engine of claim 1, wherein the training block driving assembly utilizes electromagnetic forces for moving the training block.

11. The engine of claim 1, wherein the connecting rod further comprises and a ball, and the piston further comprises a socket for mating with the ball to form a ball and socket joint.

12. A variable-cycle engine capable of alternating between two-cycle and four-cycle operation, comprising:

a cylinder block having at least one piston cylinder and a piston reciprocable in the cylinder, the cylinder block further having a crankshaft and a connecting rod;

the connecting rod connecting the piston and the crankshaft such that the piston may rotate within the cylinder on the connecting rod;

the piston having a top and a side;

the piston further having a piston port, the piston port having a first end on the piston side and a second end on the piston side;

the piston further having a first and second exhaust vent, each such exhaust vent having an exhaust intake end on the piston top and an exhaust discharge end on the piston side;

means for sequentially and repeatedly training the piston from a first to a second to a third rotation position for four-cycle operation, and, alternatively, for sequentially and repeatedly the piston from a fourth to a fifth rotation position for two-cycle operation;

a fuel charge intake port alignable with the piston port first end, when the piston is in the first rotation position, such that the fuel charge is scavenged from the intake port into the piston port first end, such scavenging being terminated when the piston is in the second rotation position;

a first scavage port positioned such that, When the piston is in the first rotation position, the piston port second end scavenges the fuel charge into the first scavage port and the first scavage port discharges the fuel charge into the cylinder above the piston top, the first scavage port being further positioned such that the fuel charge scavenging into the first scavage port is terminated when the piston is in the second rotation position;

an exhaust port positioned for receiving exhaust from the piston first exhaust vent discharge end when the piston is in the third rotation position; and a second scavage port positioned such that, when the piston is in the fourth rotation position, the intake passage scavenges the fuel charge into the piston port second end intake and exhaust happening simultaneously, the piston port first end discharges the fuel charge into the second scavage port, and the second scavage port discharges the fuel charge into the cylinder above the piston top and exhaust port being aligned to receive exhaust from the piston second exhaust vent discharge end, the second scavage port being further positioned such that the fuel charge discharge from the second scavage port terminates when the piston is in the fifth rotation position compression/ignition in the fifth rotation position all ports are closed and compression/ignition occurs.

13. The engine of claim 12, wherein the means for intake/exhaust cycles between positions four and five compression/ignition, training the piston comprises at least one engine operational condition detector and a controller, the controller analyzing the detected engine operating conditions and adjusting piston training in accordance with predetermined conditions necessitating such an adjustment.

14. A variable-cycle engine capable of alternating between two-cycle and four-cycle operation, comprising:

a cylinder block having at least one piston cylinder and a piston reciprocable in the cylinder, the cylinder block further having a crankshaft and a connecting rod, the cylinder further having a training block, the training block being movable about the inner periphery of the cylinder;

the connecting rod further having a ball and the piston further having a socket for mating with the ball to form a ball and socket joint, such that the piston may rotate within the cylinder on the connecting rod;

the piston having a top and a side;

the piston further having a piston port, the piston port having a first end on the piston side and a second end on the piston side;

the piston further having a first and second exhaust vent, each such exhaust vent having an exhaust intake end on the piston top and an exhaust discharge end on the piston side;

the piston further having a tail member extending to and received by the training block such that the piston rotates within the cylinder as the training block moves;

a detector for detecting the operational conditions of the engine;

at least one sensor for detecting engine speed and engine load, and a microprocessor, the microprocessor analyzing the sensed engine operating conditions;

a training block driving assembly for receiving signals from the microprocessor and selectively causing the training block to sequentially and repeatedly move from a first to a second to a third position for four-cycle operation, and, alternatively, for selectively causing the training block to sequentially and repeatedly move from a fourth to a fifth position for two-cycle operation, the movement of the training block causing the piston to rotate into five rotation positions corresponding with the five positions of the training block, the microprocessor signals causing the training block driving assembly to move the training block movement in accordance with predetermined conditions necessitating such movement;

a fuel charge intake port alignable with the piston port first end, when the piston is in the first rotation position, such that the fuel charge is scavenged from the intake port into the piston port first end, such scavenging being terminated when the piston is in the second rotation position;

a first scavage port positioned such that, when the piston is in the first rotation position, the piston port second end discharges the fuel charge into the first scavage port and the first scavage port discharges the fuel charge into the cylinder above the piston top, the first scavage port being further positioned such that the fuel charge discharge into the first scavage port is terminated when the piston is in the second rotation position;

an exhaust port positioned for receiving exhaust from the piston first exhaust vent discharge end when the piston is in the third rotation position; and a second scavage port positioned such that, when the piston is in the fourth rotation position, the intake passage scavenges the fuel charge into the piston port second end, the piston port first end discharges the fuel charge into the second scavage port, and the second scavage port discharges the fuel charge into the cylinder above the piston top and intake and exhaust happen simultaneously, the second scavage port being further positioned such that the fuel charge and exhaust port being aligned to receive exhaust from the piston second exhaust vent discharge end, discharge from the second scavage port terminates when the piston is in the fifth rotation position, the exhaust port, in this fifth rotation position, being aligned to receive exhaust from the piston second exhaust vent discharge end.

15. A method for alternating between two-cycle and four-cycle operation of an internal combustion engine, comprising the steps of:

connecting a piston to a crankshaft such that the piston is rotatable within a cylinder and reciprocable within the cylinder;

positioning the piston in a first rotation position such that a fuel charge is scavenged through the intake port into a piston port first end, then out a piston port second end, then into a first scavage port runner, then into a combustion chamber;

positioning the piston in a second rotation position such that the combustion chamber is sealed for compression and ignition;

positioning the piston in a third rotation position such that the exhaust from the ignition enters a first piston exhaust vent, then exits the first piston exhaust vent into a cylinder exhaust port, and then exits the cylinder;

positioning the piston in a fourth rotation position such a fuel charge is scavenged through the intake port discharges a fuel charge into a piston port second end, then out a piston port first end, then into a second scavage port runner, then into a combustion chamber, while, simultaneously, exhaust enters a second piston exhaust vent, then exits the second piston exhaust vent into the cylinder exhaust port, and then exits the cylinder; and positioning the piston in a fifth rotation position such that the combustion chamber is sealed for combustion and ignition.

16. The method of claim 15, further comprising the step of switching between two-cycle and four-cycle operation in response to measured engine operating conditions.

* * * * *